US007093578B2

(12) United States Patent
Batzill et al.

(10) Patent No.: US 7,093,578 B2
(45) Date of Patent: Aug. 22, 2006

(54) OIL OUTLET FOR A COMBUSTION ENGINE AND METHOD OF MAKING SAME

(75) Inventors: Manfred Batzill, Neuhausen (DE); Markus Huber, Munich (DE); Thomas Fassl, Eppingen (DE)

(73) Assignee: Dr. Ing. h.c.F. Porsche Aktiengesellschaft, Stuttgart (DE)

( * ) Notice: Subject to any disclaimer, the term of this patent is extended or adjusted under 35 U.S.C. 154(b) by 85 days.

(21) Appl. No.: 10/467,302

(22) PCT Filed: Jan. 25, 2002

(86) PCT No.: PCT/EP02/00790

§ 371 (c)(1),
(2), (4) Date: Aug. 7, 2003

(87) PCT Pub. No.: WO02/063144

PCT Pub. Date: Aug. 15, 2002

(65) Prior Publication Data

US 2004/0079318 A1 Apr. 29, 2004

(30) Foreign Application Priority Data

Feb. 7, 2001 (DE) ..... 101 05 435

(51) Int. Cl.
*F01M 11/06* (2006.01)

(52) U.S. Cl. ..... 123/196 R; 123/195 R

(58) Field of Classification Search ..... 123/196 R, 123/195 R, 196 S

See application file for complete search history.

(56) References Cited

U.S. PATENT DOCUMENTS 2,440,815 A 5/1948 Wharam et al.
4,519,348 A * 5/1985 Hamilton ..... 123/195 C
4,909,203 A * 3/1990 Fukuo ..... 123/196 R
5,136,993 A * 8/1992 Ampferer et al. ..... 123/195 C
5,653,205 A * 8/1997 Ozeki ..... 123/195 C
5,960,763 A * 10/1999 Yamamura ..... 123/195 C
6,260,534 B1 * 7/2001 Kampichler et al. .... 123/196 R
6,640,767 B1 * 11/2003 Kato et al. ..... 123/195 C

FOREIGN PATENT DOCUMENTS

DE 100 14 368 A1 10/2001
FR 2 721 976 1/1996

* cited by examiner

*Primary Examiner*—Henry C. Yuen
*Assistant Examiner*—Jason Benton
(74) *Attorney, Agent, or Firm*—Crowell & Moring LLP

(57) ABSTRACT

The invention relates to an oil collecting arrangement for an internal-combustion engine having an oil collecting housing (2) arranged below a crankcase, which oil collecting housing (2) has at least two sections of different space depths, in a deeper space section (4), an oil scavenging line (8) being provided by means of which the lubricating oil is delivered to the consuming devices by way of a pump. It is suggested that, in the oil collecting housing (2), a separate insertion part (18) is fastened which, on the one hand, has an oil barrier (22, 28) aligned transversely to the longitudinal dimension of the oil collecting housing (4) (2), which oil barrier (22, 28) prevents a flowing back of the lubricating oil from the deeper space section (4) into the crank space and/or into the flatter space section (12) in the inclined position of the internal-combustion engine, and which, on the other hand, has oil return ducts (34, 38, 40) for the lubricating oil flowing back from the cylinder head.

5 Claims, 8 Drawing Sheets

OIL OUTLET FOR A COMBUSTION ENGINE AND METHOD OF MAKING SAME

BACKGROUND AND SUMMARY OF THE INVENTION

The invention relates to an oil collecting arrangement for an internal-combustion engine having an oil collecting housing arranged below a crankcase, which oil collecting housing has at least two sections of different depths, in a deeper space section, an oil scavenging line being provided by way of which lubricating oil is delivered to consuming devices by way of a pump.

From U.S. Pat. No. 5,103,782, an oil collecting arrangement of the above-mentioned type is known in the case of which the oil pan or the oil collecting housing of the internal-combustion engine has two space sections which have different depths along the longitudinal dimension of the crankcase. In the deeper space section constructed as an oil pan, an oil scavenging device is provided by means of which the oil is returned to the consuming devices. For the targeted return of the oil situated in the flatter space, corresponding oil conducting ribs are provided. During uphill drives, particularly in the case of a motor vehicle having cross-country mobility, there is the risk that the lubricating oil situated in the deeper space will return into the crankcase by way of the flatter space section. In addition to splashing losses, there is the danger that, in the area of the oil scavenging device, insufficient oil will be available for the oil supply to the consuming devices, or that air is taken in instead of oil.

In addition, it is known (see Special Printing from MTZ Motortechnische Zeitschrift 52, 1991, Page 9, 10) to return lubricating oil from the cylinder head by way of oil return ducts integrated in an oil pan top part into the oil sump, which oil return ducts extend to below the oil level.

It is an object of the invention to design an oil collecting arrangement for an internal-combustion engine such that, on the one hand, a reliable and fast oil return is ensured from the consuming devices to the oil sump and that, on the other hand, it is ensured that, also in the case of an inclined position of the internal-combustion engine, a return flow of the lubricating oil from the deeper space section into the crank space and/or into the flatter space section is prevented. With respect to the manufacturing these two functions are to be integrated in a simple manner and therefore also at reasonable cost in the oil collecting arrangement.

The object is achieved in that in the oil collecting housing, a separate insertion part is fastened which, on one hand, has an oil barrier aligned approximately transversely to a longitudinal dimension of the oil collecting housing, which oil barrier prevents a flowing back of lubricating oil from the deeper space section into a crank space or into a flatter space section in an inclined position of the internal-combustion engine and which, on another hand, has oil return ducts for oil flowing back from a cylinder head. The insertion part constructed separately from the oil collecting arrangement is, on the one hand, constructed with an oil barrier required between the two space sections and, furthermore, has oil return ducts by way of which the oil flowing back from the cylinder head directly arrives under the oil level of the lubricating oil situated in the deeper space section. As a result, the oil collecting housing can be manufactured in a simple manner with respect to casting because the two above-described functions are implemented in the insertion part constructed separately with respect to the oil collecting housing.

Additional advantageous embodiments and improvements of the oil collecting arrangement according to the invention are contained in the subclaims. The insertion part consists of a center part having an oil holding edge and an oil partition wall and two side parts in which oil return ducts from the cylinder head are integrated.

The insertion part is advantageously made of plastic and, as a whole, therefore contributes to a weight reduction of the internal-combustion engine. Furthermore, such a plastic insertion part can be produced in a simple manner, for example, by means of injection molding.

An embodiment of the invention is explained in detail in the following description and drawings.

DETAILED DESCRIPTION OF THE DRAWINGS

Figure 1:
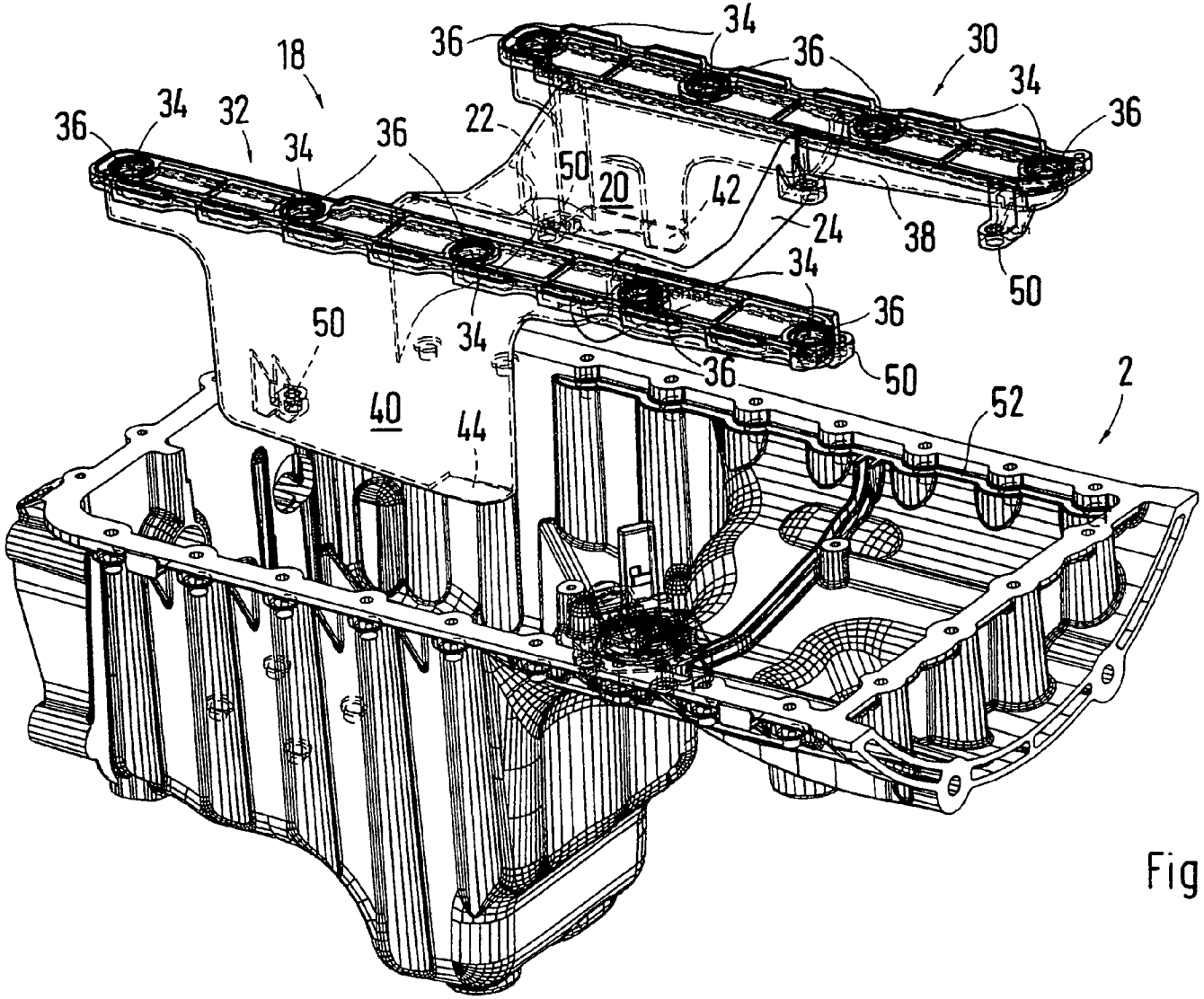
FIG. 1 shows a first perspective view of an oil collecting arrangement.

An oil collecting housing 2 has a space 4, in the following called a first oil collecting space, in which the oil collects which is necessary for the lubricating oil supply of the internal-combustion engine. In the first oil collecting space 4, an oil snorkel 6 is placed at its lowest point, which oil snorkel 6 leads by way of a first oil scavenging line 8 to the suction side of an oil pump 10. In the oil collecting housing 2, a second space 12 is arranged, which, in the following, is called a second oil collecting space and which has a flatter construction than the first oil collecting space 4. In the second oil collecting space 12, an oil snorkel 14 is also arranged at its lowest point which is connected by way of a second oil scavenging line 16 with a second suction side of the oil pump 10 constructed as a double pump 10.

Figure 2:
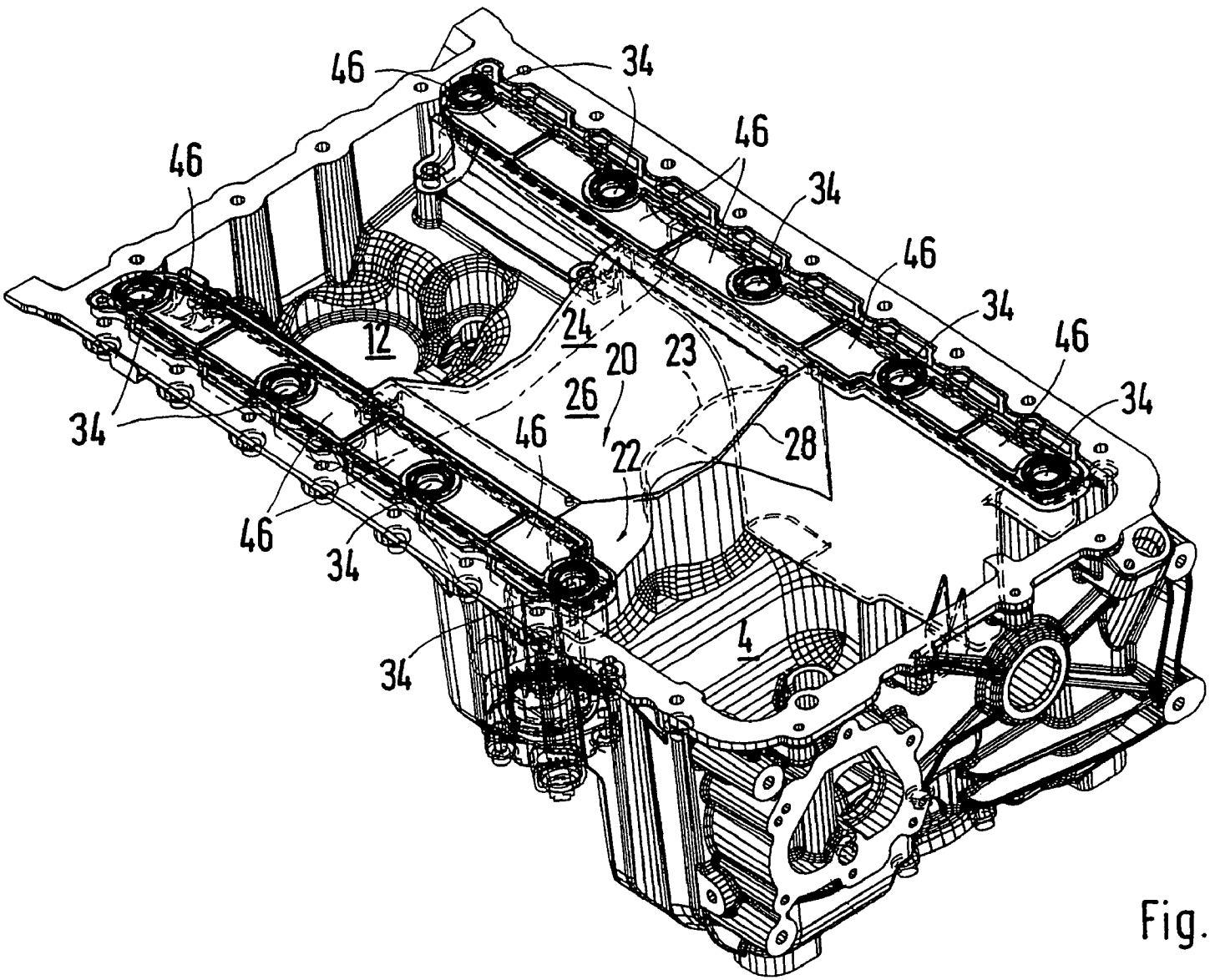
FIG. 2 shows a second perspective view of an oil collecting arrangement.
Figure 3:
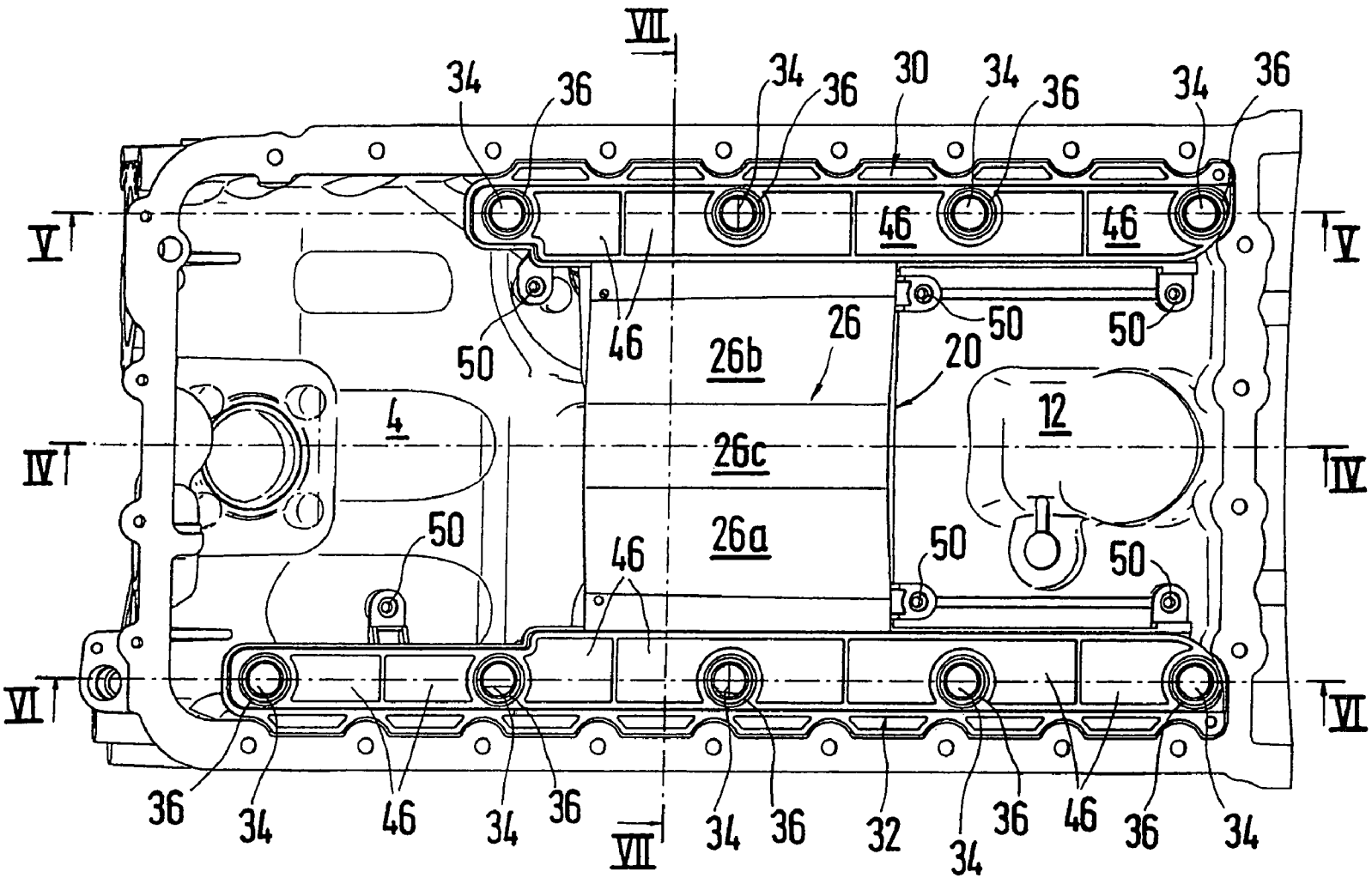
FIG. 3 shows a top view of the oil collecting arrangement.
Figure 4:
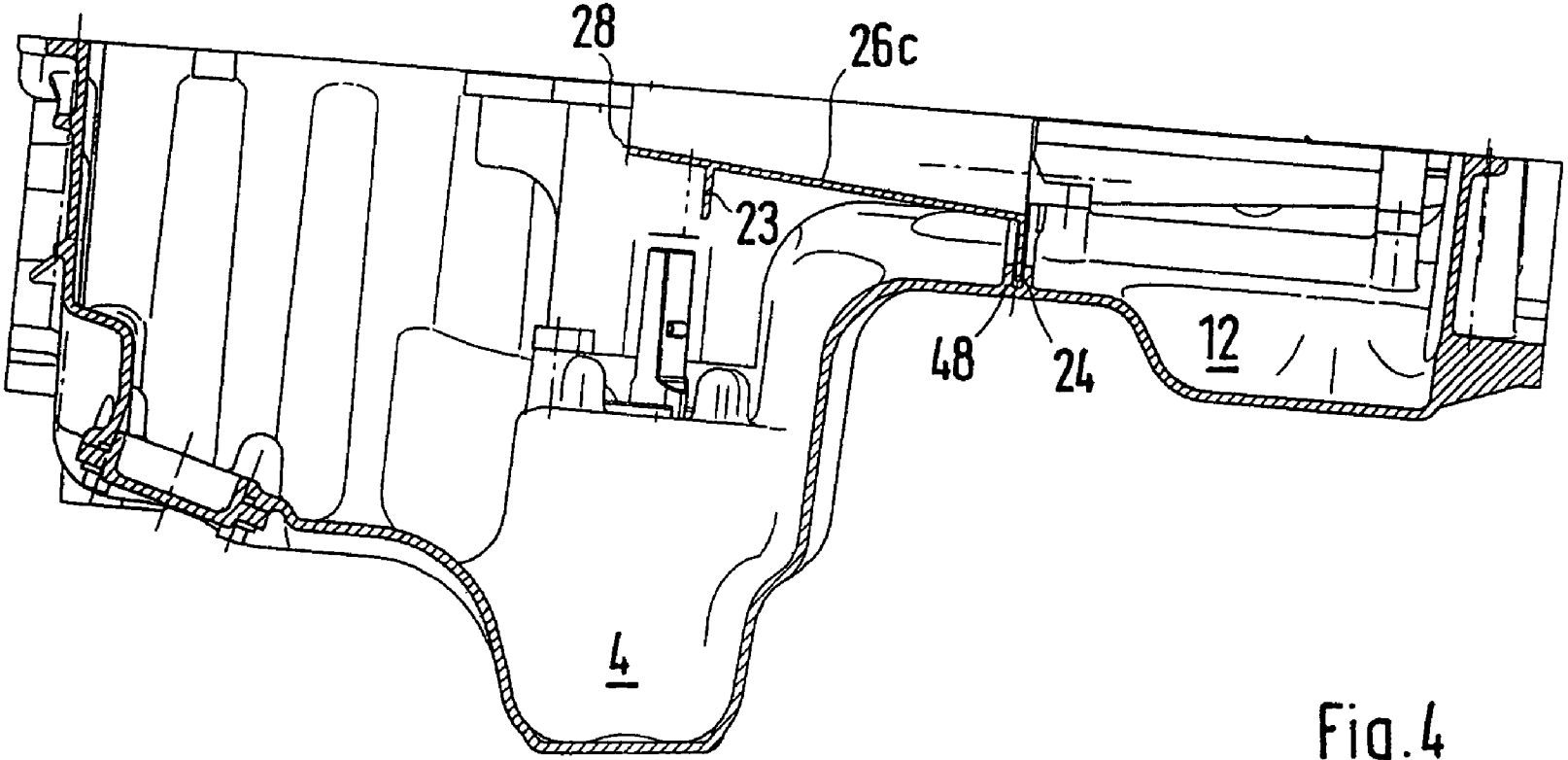
FIG. 4 shows a sectional view along Line IV—IV in FIG. 3.
Figure 5:
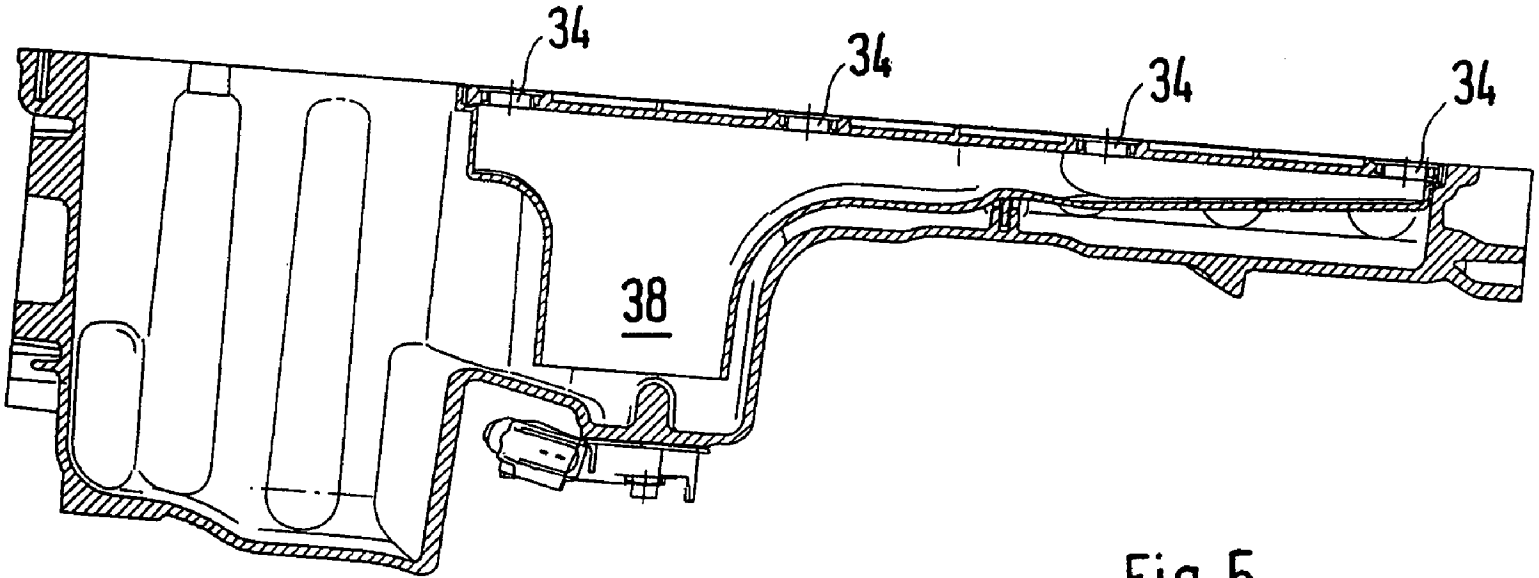
FIG. 5 shows a sectional view along Line V—V in FIG. 3.
Figure 6:
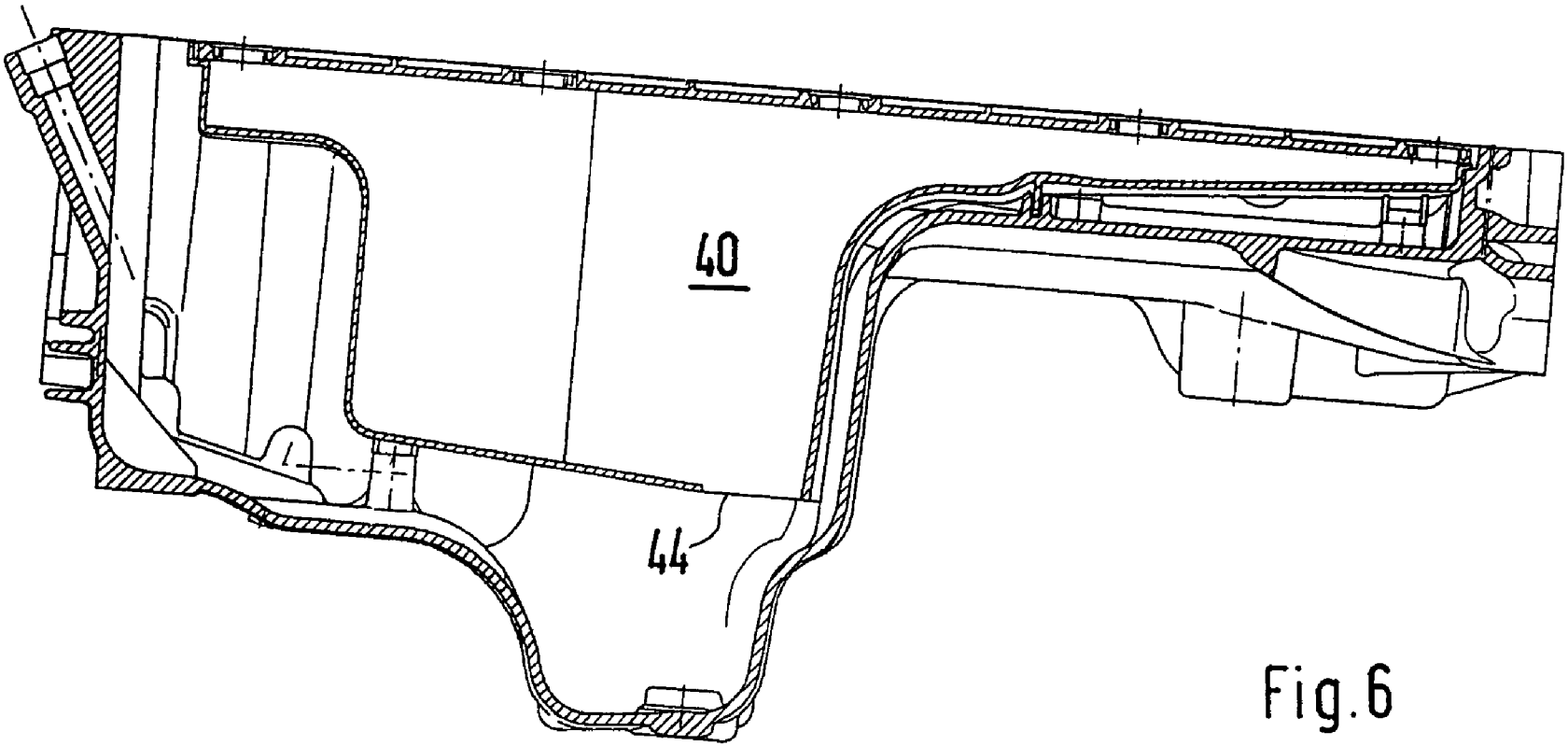
FIG. 6 shows a sectional view along Line VI—VI in FIG. 3.
Figure 7:
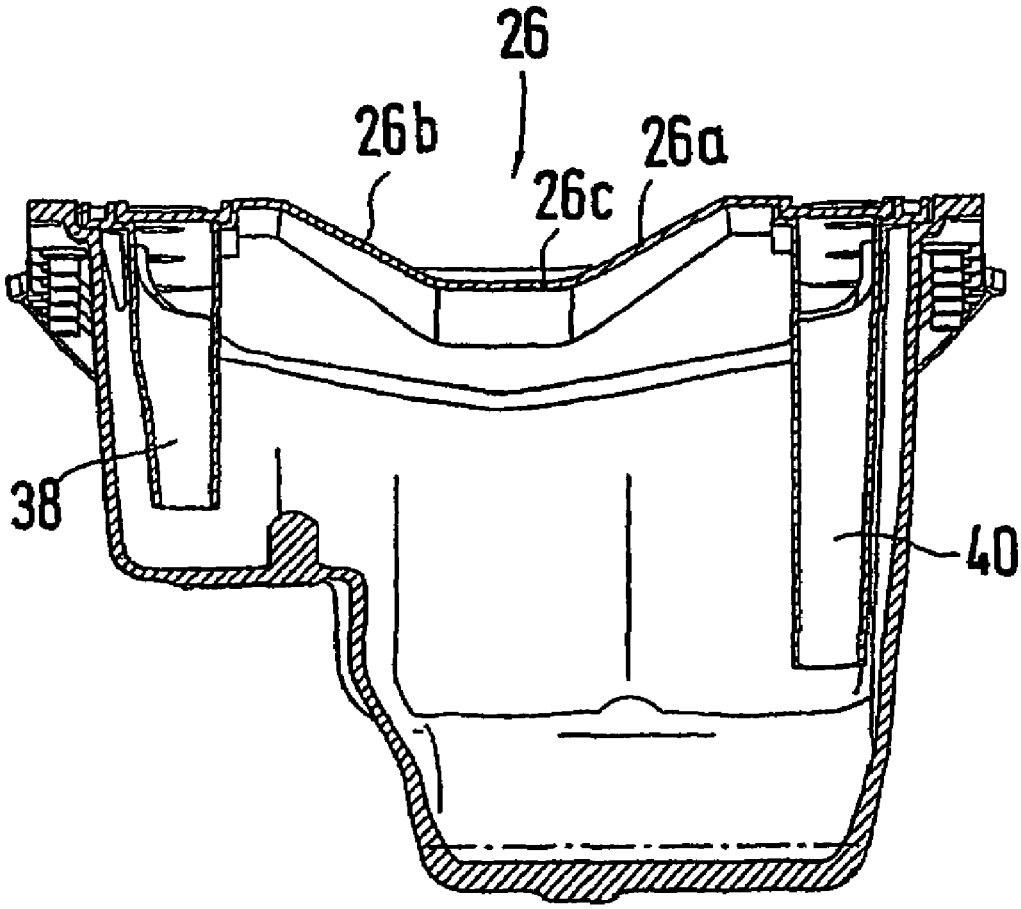
FIG. 7 shows a sectional view along Line VII—VII in FIG. 3.

A plastic insertion piece 18 is inserted in the oil collecting housing 2, the construction of which insertion piece 18 will be described in detail in the following. The insertion piece 18 has a center part 20 which, as illustrated particularly in FIGS. 2 and 3, in the installed condition, separates the two oil collecting spaces 4, 12 from one another. In this case, the center part 20 has a first side wall 22 aligned toward the first oil collecting space 4, which side wall 22 is provided with a wall section 23 forming a partition wall for the lubricating oil. A second side wall 24 separating the two oil collecting spaces 4, 12 engages in a holding groove 48 arranged on the bottom of the oil collecting space 12 and extending transversely to the longitudinal dimension of the oil collecting housing 2. This tongue-and-groove connection is additionally sealed off by silicone or flexible foam, because it is to be avoided that, in an inclined position of the motor vehicle, lubricating oil reaches the second oil collecting space 12 from the first oil collecting space 4. In contrast, the first side wall 22 of the insertion part 18 is constructed such that, particularly in an inclined position of the engine, the lubricating oil can flow from the first oil collecting space 4 under the center part 20. As a result, this space section is also utilized for receiving the oil volume required for a reliable lubricating oil supply.

Figure 8:
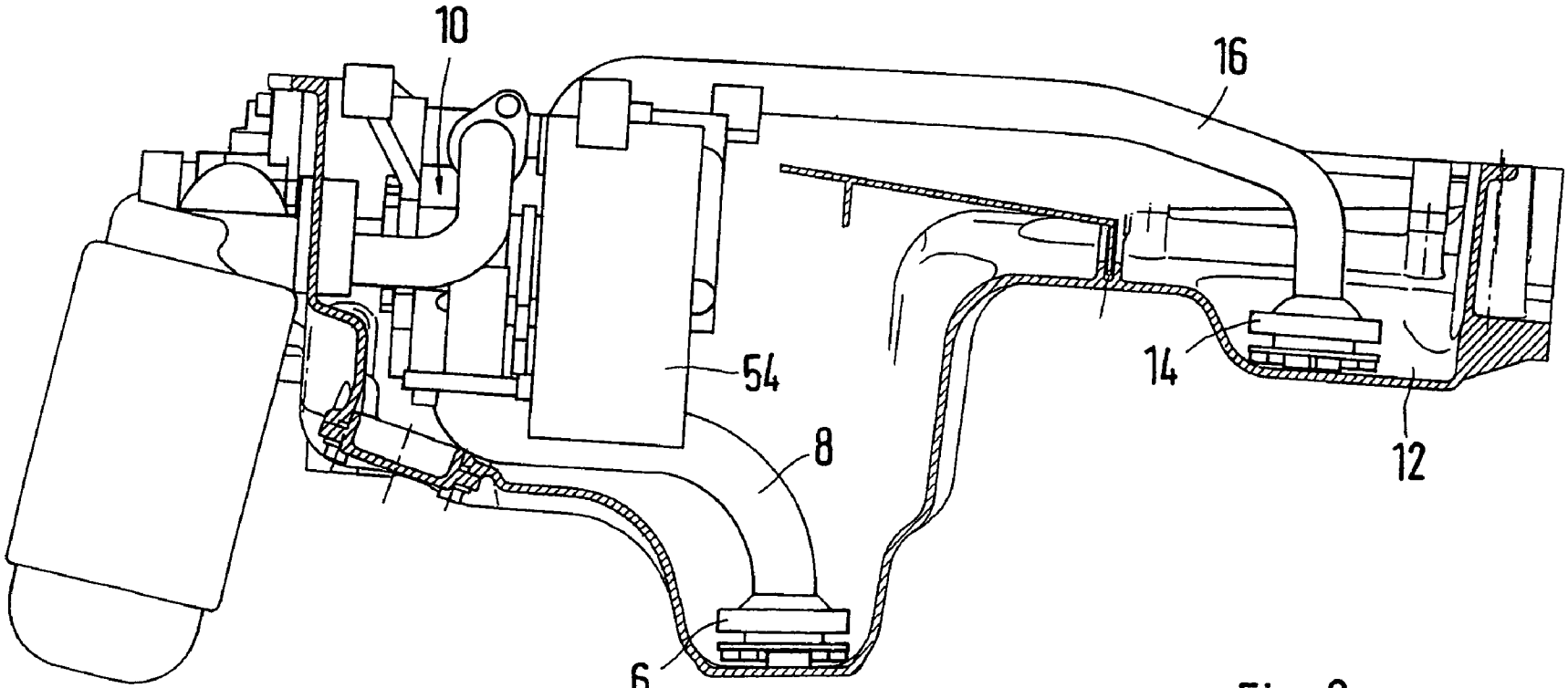
FIG. 8 shows a view of a two-stage oil pump inserted in the oil collecting arrangement.

A covering wall 26 of the center part 20 is lowered toward the center (see intersection Line IV—IV in FIG. 3) of the oil collecting housing 2 and consists of two lowered partial surfaces 26*a* and 26*b* which change in the center into a straight partial surface 26*c*. The side edge 28 of the covering wall 26 aligned toward the first oil collecting space 4, in the following called oil holding edge, is used as an oil barrier which, when the vehicle drives in hilly terrain, prevents that the lubricating oil flows from the first oil collecting space 4 into the second oil collecting space 12. As illustrated in FIG. 8, the second oil scavenging line 16 extending to the second oil collecting space 12 extends above the centrally aligned straight partial surface 26*c*.

Two side parts 30 and 32 are molded to the center part 20, in which side parts 30 and 32 some of the oil return ducts leading from the cylinder head to the first oil collecting space 4 are integrated. For this purpose, the two side parts 30 and 32 have oil return flow openings 34 which are surrounded by sealing rings 36. The side part 32 provided with five oil return flow openings 34 in the embodiment extends along the entire length of the oil collecting housing 2, while the side part 30 provided in the embodiment with four oil return flow openings 34 extends from the second oil collecting space 12 to the start of the first oil collecting space 4. The oil return flow openings 34 arranged in the two side parts 30 and 32 lead into one oil collecting duct 38 and 40 respectively which are provided at their lower ends with one oil discharge opening 42 and 44 respectively. The two oil collecting ducts 38 and 40 are closed off, with the exception of the oil return flow openings 34 leading to the crankcase (not shown), by way of covering elements 46 which are fastened, for example, by vibration welding, to the side parts 30, 32.

When the oil collecting housing 2 is screwed to a crankcase bottom part, which is not shown, the bores made on the flange surface of the crankcase bottom part corresponding to the oil return flow openings 34 are sealingly fitted by way of their bore edges on the sealing rings 36. By way of the oil return flow ducts integrated in the crankcase and the oil collecting ducts 38 and 40 extending below the oil level of the lubricating oil situated in the first oil collecting space 4, it is ensured that the lubricating oil, despite the pressure pulsations caused by crankshaft and piston movements, is rapidly returned from the consuming devices back into the first oil collecting space 4. The second oil collecting space 12 collects the lubricating oil from the main bearings and the lubricating oil from the injection nozzles, which are not shown, for the piston cooling, which lubricating oils are pumped by way of the second oil scavenging line 16 back into the first oil collecting space 4.

The plastic insertion part 18 fixed by way of the engagement of the side wall 24 in the holding groove 48 is screwed on in a captive manner by way of fastening lugs 50 molded to the center part 20 and to the two side parts 30 and 32 in the oil collecting housing 2. On both longitudinal sides of the oil collecting housing 2, a sealing surface 52 is provided by way of which the insertion part 18 is sealed off with respect to the oil guiding housing 2 with its two side parts 30 and 32.

Particularly because of the oil holding edge 28 constructed as an oil barrier and because of the oil partition wall 23, the insertion part 18 is designed such that, also during uphill driving of the vehicle of up to 45°, it is prevented that the lubricating oil can flow from the first oil collecting space 4 into the crank space and/or into the second oil collecting space 12. By way of the oil scavenging line 16 arranged in the second oil collecting space 12, it is ensured that, independently of the inclined position of the vehicle, the lubricating oil from the second oil collecting space 12 by way of the oil scavenging line 16 and by way of an air separator 54 reaches the first oil collecting space 4, from where it is returned to the consuming devices by way of the first pumping stage. Because both pumping stages operate constantly, it is ensured by the air separator 54 that the air taken in, particularly during downhill driving or when the motor vehicle is braked, from the second oil collecting space 12 is separated and therefore does not reach the crankcase or the consuming devices.

The invention claimed is:

1. Oil collecting arrangement for an internal-combustion engine comprising:

an oil collecting housing arranged below a crankcase, said oil collecting housing having at least two sections of different depths, in a deeper space section, an oil scavenging line being provided by way of which lubricating oil is delivered to consuming devices by way of a pump, and a plastic insertion part, separate from and screwed into the oil collecting housing, which has an oil barrier aligned approximately transversely to a longitudinal dimension of the oil collecting housing, wherein said oil barrier prevents a flowing back of the lubricating oil from the deeper space section into a crank space or into a flatter space section in an inclined position of the internal-combustion engine, and wherein said insertion part has oil return ducts for oil flowing back from a cylinder head.

2. Oil collecting arrangement according to claim 1, wherein the insertion part is made of a center part separating the two space sections and having an oil holding edge, and of two side parts accommodating the oil return ducts.

3. Oil collecting arrangement according to claim 2, wherein the two side parts have oil return flow openings which each lead into a collecting duct which extends into the deeper space section.

4. Oil collecting arrangement according to claim 2, wherein a holding groove is provided in the flatter space section, a side wall of the center part engaging in the holding groove.

5. Oil collecting arrangement according to claim 3, wherein a holding groove is provided in the flatter space section, a side wall of the center part engaging in the holding groove.

* * * * *